US010035113B2

(12) United States Patent
Nasman et al.

(10) Patent No.: US 10,035,113 B2
(45) Date of Patent: Jul. 31, 2018

(54) METHOD AND SYSTEM FOR A SPIRAL MIXER

(71) Applicant: Tokyo Electron Limited, Tokyo (JP)

(72) Inventors: Ronald Nasman, Averill Park, NY (US); Anton J. deVilliers, Clifton Park, NY (US)

(73) Assignee: Tokyo Electron Limited, Tokyo (JP)

( * ) Notice: Subject to any disclaimer, the term of this patent is extended or adjusted under 35 U.S.C. 154(b) by 386 days.

(21) Appl. No.: 14/738,128

(22) Filed: Jun. 12, 2015

(65) Prior Publication Data

US 2016/0250606 A1 Sep. 1, 2016

Related U.S. Application Data

(60) Provisional application No. 62/121,128, filed on Feb. 26, 2015.

(51) Int. Cl.
*B01F 5/00* (2006.01)
*B01F 5/06* (2006.01)
(Continued)

(52) U.S. Cl.
CPC ..... *B01F 5/0065* (2013.01); *B01F 5/064* (2013.01); *B01F 13/0059* (2013.01);
(Continued)

(58) Field of Classification Search
CPC .... B01F 5/0057; B01F 5/0062; B01F 5/0064; B01F 5/0065; B01F 15/00935; B01F 13/0059; B01F 2215/0096
(Continued)

(56) References Cited

U.S. PATENT DOCUMENTS 3,394,924 A * 7/1968 Harder ..... B01F 5/0644 366/338
3,927,868 A * 12/1975 Moore ..... B01F 3/10 206/221

(Continued)

OTHER PUBLICATIONS

Wikipedia, Fick's Laws of Diffusion, //https://en.wikipedia.org/wiki/Fick%27s_laws_of diffusion, Jul. 29, 2015, 9 pp.

*Primary Examiner* — Walter D. Griffin
*Assistant Examiner* — Marc C Howell
(74) *Attorney, Agent, or Firm* — Wood Herron & Evans LLP

(57) ABSTRACT

Included is a method and system of generating a diffused fluid using a spiral mixer comprising: injecting a first fluid into a first inlet port, generating a first fluid ribbon using a first narrow-gap slot; injecting a second fluid into a second inlet port and generating a second fluid ribbon; combining the first fluid and the second fluid ribbon into a spiraling flow around a cone feature in the mixing chamber of the first spiral mixing block, generating a combined flow of diffused fluids; dividing the combined flow in the mixing chamber of the first flow divider block, generating a divided flow of diffused fluids; combining the divided flow a mixing chamber of the final spiral mixing block, generating a final combined fluid flow in a spiraling flow around a final cone feature; and flowing the final combined fluid flow and dispensing the combined fluid flow onto a substrate.

18 Claims, 7 Drawing Sheets

(51) Int. Cl.
*B01F 13/00* (2006.01)
*B01F 13/10* (2006.01)
*B01F 15/00* (2006.01)

(52) U.S. Cl.
CPC .... *B01F 13/1027* (2013.01); *B01F 15/00935* (2013.01); *B01F 2215/0096* (2013.01)

(58) Field of Classification Search
USPC ..... 366/173.1
See application file for complete search history.

(56) References Cited

U.S. PATENT DOCUMENTS

| | | | | |
|---|---|---|---|---|
| 4,087,862 | A * | 5/1978 | Tsien | B01F 5/0057 366/165.1 |
| 6,082,889 | A | 7/2000 | Tortosa | |
| 6,457,854 | B1 * | 10/2002 | Koop | B01F 5/064 366/336 |
| 6,655,827 | B1 | 12/2003 | Tortosa | |
| 8,313,716 | B2 | 11/2012 | Miller et al. | |
| 2009/0207687 | A1 * | 8/2009 | Kemperman | B01F 5/0451 366/132 |
| 2011/0103176 | A1 | 5/2011 | Van Dam et al. | |

* cited by examiner

METHOD AND SYSTEM FOR A SPIRAL MIXER

FIELD OF INVENTION

The invention relates to a method and system of mixing two or more fluids in a spiraling flow and specifically to mix the fluids to meet a non-uniformity target and preserve the chemical structure of the fluids.

DESCRIPTION OF RELATED ART

In semiconductor manufacturing, there is a need for a fluid mixing device that combines and uniformly blends two chemical streams for immediate dispense on a substrate or dispense onto a processing chamber. The issues related to mixing two chemical streams are related to non-uniformity of the mixing and the volume of the fluids required for mixing. Uniformity of fluid mixing is needed in order for the subsequent processes to be performed as required. The mechanics of fluid flow are also important as turbulence in the flow may destroy or alter the chemical structure of the fluids. Types of flow at transition points and presence of dead legs or recirculation loops affect the uniformity of the fluid mixing and the amount of fluid needed for the mixing. One method of addressing the flow issues is ensuring that the flows of the two fluids are smooth at connection points.

The fluids selected for mixing must be compatible with materials in the substrate or with subsequent materials applied to the substrate in subsequent processing. In addition, the fluids must have a density or viscosity that is compatible with the objectives of the mixing process. Although mixing increases with turbulence, as noted above, turbulence in the mixing process may degrade or alter the fluids being mixed. Thus, non-turbulent flows rely on diffusion for uniform mixing. Depending on the application and how the mixed fluid is integrated in the fabrication system, there are physical and layout requirements for the method and system used to mix the fluids. Diffusion is a slow process and is a function of concentration gradient of the fluid and distance travelled by the fluids. There is a need for a fluid mixing system that is configured to have zero dead legs or recirculation loops, to minimize the volume of the first fluid and the second fluid needed for mixing, and to minimize the turbulence of mixing in order to preserve the chemical structure of the first fluid and the second fluid. Moreover, there is a need for selecting fluids that are compatible with materials used in the application. Furthermore, for a given diffusivity of the first fluid and the second fluid, a target flow rate of the mixed fluid, and a target length of the flow and target dimension of the mixing system must be met. In addition, the mixing system and method must meet a non-uniformity target for the diffused fluid.

SUMMARY OF THE INVENTION

Included is a system designed to combine and uniformly blend two or more fluids, the system comprising a spiral mixer, the spiral mixer comprising: a first injector configured to inject a first fluid into a first inlet port of an input block of the spiral mixer, generating a first fluid ribbon; a second injector configured to inject a second fluid into a second inlet port of the input block, generating a second fluid ribbon; a mixing module coupled to the first injector and the second injector and configured to receive the first fluid ribbon and the second fluid ribbon from the inlet block via a mixing chamber and perform a mixing process, wherein the mixing chamber comprises machined holes and mixing devices, the mixing module generating two mixed spiraling flows, the mixing module comprising: a first spiral mixing block coupled to the inlet block via first mixing chamber and configured to perform a first stage mixing of the first fluid ribbon and the second fluid ribbon in a smooth combined spiraling flow; a flow divider block coupled to the first spiral mixing block via a flow divider mixing chamber and configured to divide the combined spiraling flow into two mixed spiraling flows; a final spiral mixing block coupled to the flow divider block and configured to combine the two mixed spiraling flows into a combined mixed spiraling flow using a final mixing chamber and configured to refine a mixing uniformity of the combined mixed spiraling flows, generating a combined final spiraling flow; and an outlet block coupled to the final mixing block and configured to continue mixing of the first fluid and the second fluid in an outlet mixing chamber to achieve target mixing objectives; wherein two or more selected mixing variables of the mixing process are concurrently controlled and kept within acceptable ranges in order to achieve the target mixing objectives.

Also included is a method of generating a diffused fluid using a spiral mixer, the method comprising: injecting a first fluid into a first inlet port of an input block of the spiral mixer and generating a first fluid ribbon of the first fluid using a first narrow-gap slot coupled to the first inlet port, the spiral mixer comprising ports, mixing chambers of the input block, first spiral mixing block, first flow divider block, final spiral mixing block, and outlet block and mixing devices; injecting a second fluid into a second inlet port of the input block and generating a second fluid ribbon of the second fluid using a second narrow-gap slot coupled to the second inlet port of the spiral mixer; combining the first fluid ribbon and the second fluid ribbon into a spiraling circular flow around a cone feature in the mixing chamber of the first spiral mixing block, generating a combined spiraling flow of diffused fluids; dividing the combined spiraling flow in the mixing chamber of the first flow divider block, generating a divided flow of the diffused fluids; combining the divided flow of the diffused fluids using a final spiral mixing block of a mixing chamber of the final spiral mixing block, generating a final combined fluid flow in a smooth circular spiraling flow around a final cone feature; and flowing the final combined fluid flow in the mixing chamber of the outlet block.

The target mixing objectives can include non-uniformity percentage of the outlet spiraling flow; absence of turbulence in the spiraling flows of the first fluid ribbon and the second fluid ribbon through the mixing chamber of the input block, absence of turbulence of the spiraling flows in the mixing chamber in the mixing module, the final mixing block, and the outlet block; absence of dead legs or recirculation loops in the mixed spiraling flows of the first fluid and the second fluid through the mixing chambers of the spiral mixer, residence time, and total volume of the first fluid and the second fluid. The method further comprises concurrently controlling two or more mixing variables of the mixing process in one or more operations in order to meet the target mixing non-uniformity of the diffused fluid; wherein the two or more mixing variables include force of injection of the first fluid, force of injection of the second fluid, density and/or viscosity of the first fluid and the second fluid, flow rate of the diffused fluid, back pressure of the downstream mixing chamber, residence time of the first fluid and the second fluid in the downstream mixing chamber, and outlet pressure at the end of the outlet block.

DETAILED DESCRIPTION OF SEVERAL EMBODIMENTS

In the following description, for purposes of explanation and not limitation, specific details are set forth, such as a particular geometry of a processing system, descriptions of various components and processes used therein. However, it should be understood that the invention may be practiced in other embodiments that depart from these specific details.

Similarly, for purposes of explanation, specific numbers, materials, and configurations are set forth in order to provide a thorough understanding of the invention. Nevertheless, the invention may be practiced without specific details. Furthermore, it is understood that the various embodiments shown in the figures are illustrative representations and are not necessarily drawn to scale.

Various operations will be described as multiple discrete operations in turn, in a manner that is most helpful in understanding the invention. However, the order of description should not be construed as to imply that these operations are necessarily order dependent. In particular, these operations need not be performed in the order of presentation. Operations described may be performed in a different order than the described embodiment. Various additional operations may be performed and/or described operations may be omitted in additional embodiments.

"Substrate" as used herein generically refers to the object being processed in accordance with the invention. The substrate may include any material portion or structure of a device, particularly a semiconductor or other electronics device, and may, for example, be a base substrate structure, such as a semiconductor wafer or a layer on or overlying a base substrate structure such as a thin film. Thus, substrate is not intended to be limited to any particular base structure, underlying layer or overlying layer, patterned or un-patterned, but rather, is contemplated to include any such layer or base structure, and any combination of layers and/or base structures. The description below may reference particular types of substrates, but this is for illustrative purposes only and not limitation.

Figure 1:
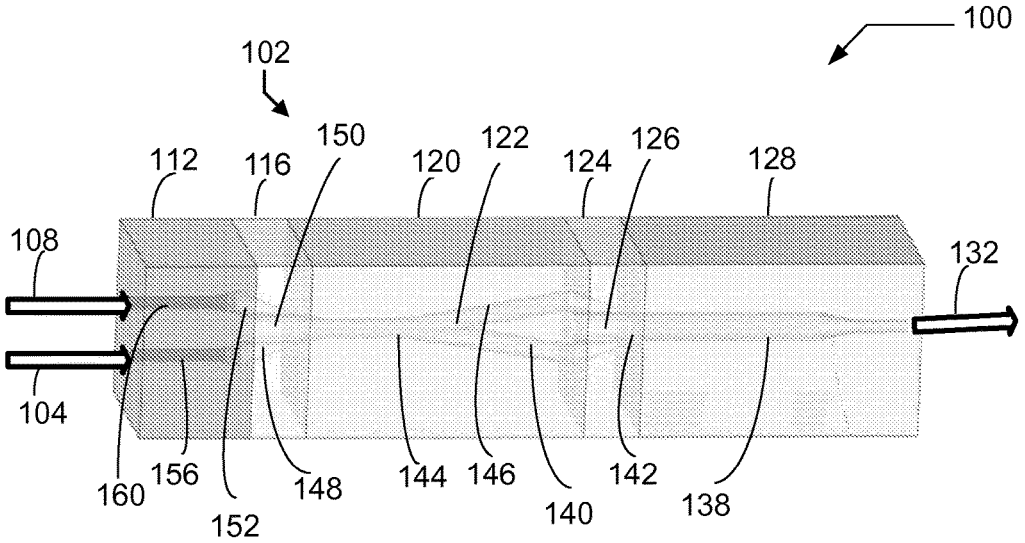
FIG. 1 shows a schematic representation of a system for mixing two fluids in a spiral mixer according to an embodiment of the present invention.

FIG. 1 shows a schematic representation 100 of a system for mixing two fluids in a spiral mixer 102 according to an embodiment of the present invention. The spiral mixer 102 comprises at least five blocks, namely, an input block 112, a first spiral mixing block 116 , a first flow divider block 120, a final spiral mixing block 124, and an outlet block 128. A first fluid 108 is injected into a first port (not shown) and becomes a first fluid ribbon 160 and a second fluid 104 is injected into a second port (not shown) and becomes a second fluid ribbon 156. The first fluid ribbon 160 is converted into a spiraling fluid 152 and the second fluid ribbon 156 is converted into spiraling fluid 148 and are combined in the first mixing chamber 150 of the first spiral mixing block 116 and generate a smooth circular combined spiraling flow 144 in the first flow divider block 120. The combined spiraling flow 144 is divided in the flow divider mixing chamber 122 into two spiraling flows, 146 and 140, in the first flow divider block 120.

Referring to FIG. 1, the two mixed spiraling flows, 146 and 140, are combined into a single combined final spiraling flow 142 in the final mixing chamber 126, proceeding into the outlet mixing chamber 138 in outlet block 128. The combined final spiraling flow 142 is flowed through the outlet mixing chamber 138 which can be adjusted to shorten or lengthen the distance that the combined final spiraling flow 142 travels based on the requirements of the application. From the outlet block 128, the outlet spiraling flow 132 is delivered to a dispense device, (shown in FIG. 10.)

Figure 2:
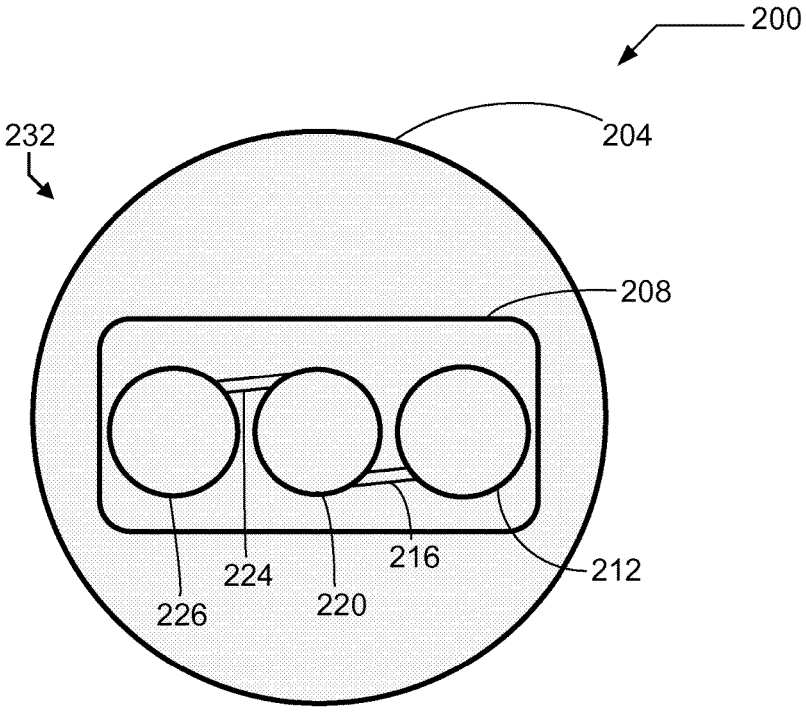
FIG. 2 shows a schematic representation of an input block for injecting two fluids into a spiral mixer according to another embodiment.

FIG. 2 shows a schematic representation 200 of an input block 204 for injecting two fluids into the spiral mixer 232 according to another embodiment. A first fluid is injected into a first inlet port 212 of a spiral mixer 232, generating a first fluid ribbon (not shown) using a first narrow-gap slot 216 coupled to the first inlet port 212. A second fluid is injected into a second inlet port 226 of the spiral mixer 232, generating a second fluid ribbon (not shown) using a second narrow-gap slot 224 coupled to the second inlet port 226. The first fluid ribbon and the second fluid ribbon are collected by the mixer nozzle 220 and mixed in the succeeding mixing chambers of the downstream blocks of the spiral mixer 232. The first and second inlet ports, 212 and 226, the first and second narrow-gap slots, 216 and 224, and the mixer nozzle 220 are enclosed in the nozzle compartment 208.

In another embodiment, a third fluid is injected into a third inlet port (not shown) of the spiral mixer 232, generating a third fluid ribbon (not shown) using a third narrow-gap slot (not shown). In yet another embodiment, additional fluids (not shown) can be injected into additional inlet ports (not shown) of the spiral mixer 232, generating additional fluid ribbons (not shown) using additional narrow-gap slots (not shown). In still another embodiment, a single inlet port can be used sequentially to inject two or more fluids at different flow rates and velocities of the spiraling flow. People knowledgeable in the art can utilize data on each fluid such as flow rate, viscosity, force of injection, velocity of the spiraling flow, residence time, and pressure profile in the mixing chamber to determine the sequence and timing of each injection to achieve diffusion desired for the fluids involved.

Figure 3:
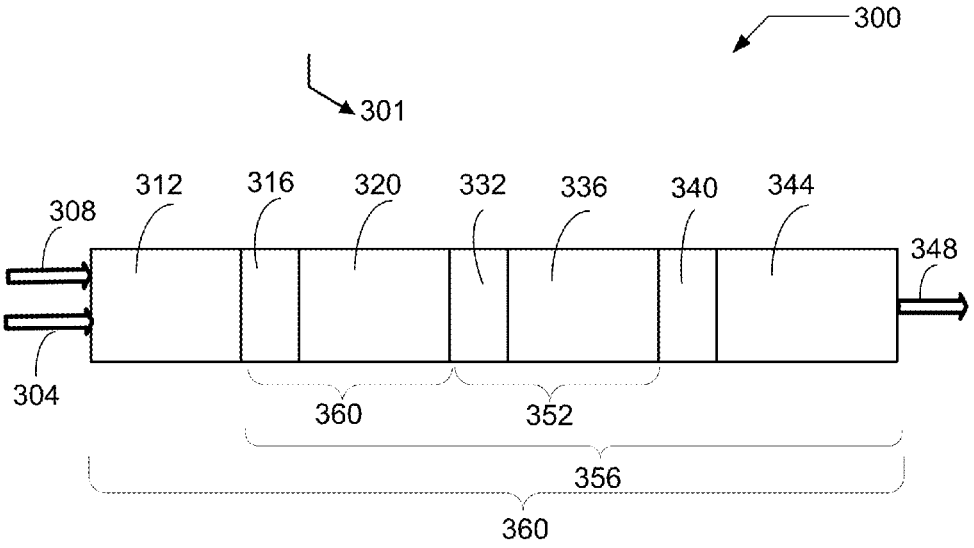
FIG. 3 shows a schematic representation of two mixing modules for a spiral mixer according to another embodiment.

FIG. 3 shows a schematic representation 300 of two mixing modules, 360 and 352, of a spiral mixer 301 according to another embodiment. The combination of a spiral mixing block 316 and a flow divider block 320 is called a mixing module 360. The spiral mixer 301 can include one or more mixing modules, 360 and 352, where the number of mixing modules is determined by the application and objectives of the mixing process. The diffusion of the first fluid 308 and the second fluid 304 is a function of the concentration gradient of the fluids and the length of the mixing chamber (not shown) and distance travelled by the mixed spiraling flow, referred to as downstream mixing chamber 356. Other factors that affect the rate of diffusion include viscosity and/or density of the first fluid and the second fluid, the flow rate, residence time, velocity of the spiraling flow, force of injection of the first fluid and the second fluid, thepressure profile in the mixing chamber, and the effective total length travelled by the spiraling flow. The total length 360 of the spiral mixer 301 is an important design consideration during the integration of the spiral mixer 301 in a semiconductor fabrication cluster such as a clean track unit.

Figure 4:
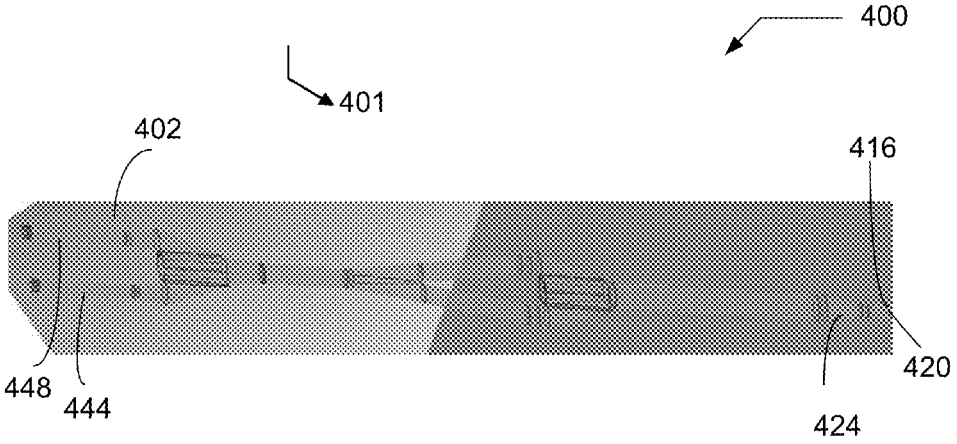
FIG. 4 shows a schematic representation of simulation of a spiral mixer using deionized water and a developer solution in an embodiment.

FIG. 4 shows a schematic representation 400 of simulation of a spiral mixer 401 using deionized water as the first fluid 448 and a developer solution 444 as the second fluid. The first fluid 448 was injected with a force in a range from 5.0 to 9.0 e-4 kg/s while the second fluid 444 was injected with a force in a range from 1.0 to 4.0 e-4 kg/s in the input block 402. The viscosity of the first fluid 448 and the second fluid 444 is similar to the viscosity and density of water. The flow rate of the first fluid 448 and second fluid 444 is in a range from 0.5 to 3.0 cc/s, back pressure of the mixing module is in a range from 0.1 to 0.9 psi, residence time of the first fluid and second fluid in the mixing module is in a range from 0.1 to 0.5 s, outlet pressure at the end of the outlet block 416 in a range from 0.1 to 0.9 psi. Using steady state simulation and including turbulence factors in the calculations, the simulations met and often exceeded the expected results. The inventor found that there were no recirculation loops or dead legs in the spiral flow of the first spiral mixing block, the final mixing block, the dividing block, and the outlet block, a low non-uniformity of less than 1% was achieved, the volume of the fluids needed was low and the fluids had a short residence time in the spiral mixer 401.

Figure 5:
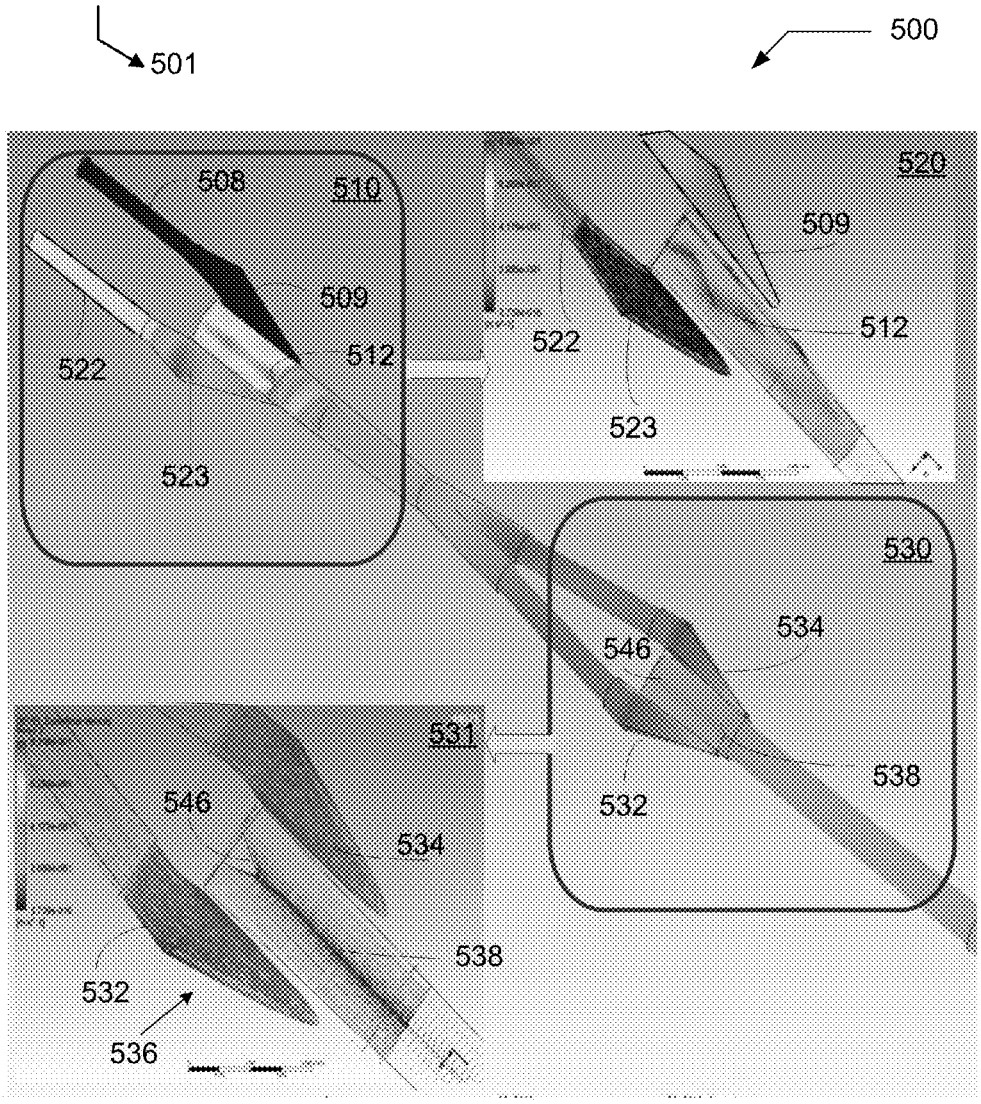
FIG. 5 depicts a schematic of the velocity profile at the critical junctions of a spiral mixer where no recirculation points are identified in an embodiment.

FIG. 5 depicts a schematic 500 of the velocity profile at the mixing loops of a spiral mixer 501 where no recirculation loops are identified in an embodiment. A close-up of the first spiral mixing block 510 is further highlighted in a velocity profile view 520 of the area where spiral mixing occurs. The first fluid 508 and the second fluid 522 are injected into the first port and second port of the input block, respectively, and come out as opposing thin ribbons of the fluids into a cylindrical volume of the first spiral mixing chamber 512 of the first spiral mixing block 510, one ribbon on top of the other, creating a smooth circulation flow in the first spiral mixing chamber 512. The first spiral mixing chamber 512 includes a spear-shaped machine hole where opposing thin ribbons of the first and second fluid start to mix in a spiral flow. The first spiral mixing chamber 512 is a machined hole in the first spiral mixing block 510. Blocks of the spiral mixer can be fabricated from perfluoro-alkoxy (PFA), polychloro-triflouro-ethylene (PCTFE), or polytetra-flouro-ethylene (PTFE). The inventor found out that matched input flows of the first fluid and the second fluid produced a very stable circular spiraling flow and there were no recirculation loops.

The final spiral mixing block 530 comprising the final mixing chamber 538 and cone feature 546 shown in the rounded square is further highlighted in a close-up 531 where one portion of the divided fluid flow 534 is combined with another portion of the divided fluid flow 532 in a cylindrical volume 538. The top of the cylindrical volume includes a cone feature 546 that prevents formation of a recirculation loop. The final spiral mixing chamber 536 includes a spear-shaped machine hole where opposing spiraling flows of the first and second fluid mix in a combined spiral flow. The inventor noted that no recirculation loops developed during simulation of the entire flow pattern.

Figure 6:
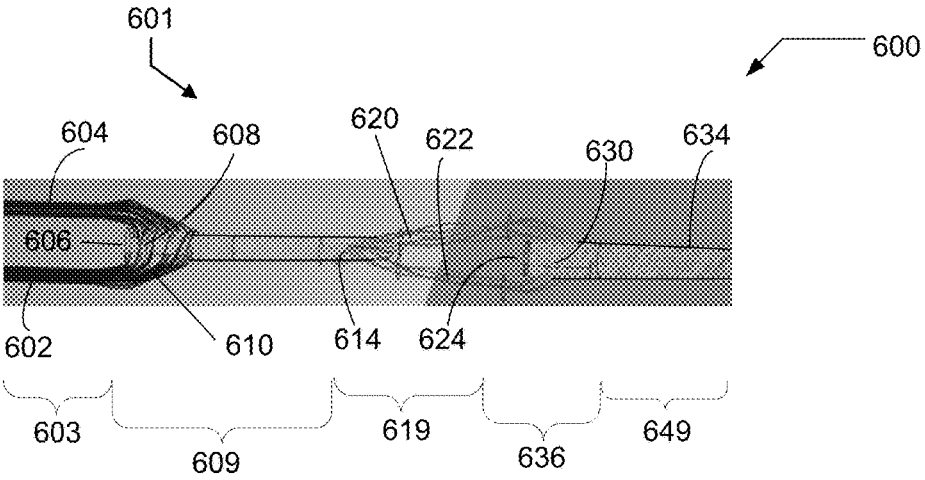
FIG. 6 depicts a schematic of the velocity profile of the separate and combined flows in a simulation highlighting spiral mixing in the outlet block of a spiral mixer in an embodiment.

FIG. 6 depicts a schematic 600 of the velocity profile of the separate and combined flows in a simulation highlighting spiral mixing of the fluids and in the outlet block of the spiral mixer 601 in an embodiment. After injection of the first fluid 604 and injection of the second fluid 602 in the input block 603, these fluids mix in the first spiral mixing block 609 and form a combined spiraling flow 608 in the first mixing chamber 610. In the flow divider block 619, the combined spiraling flow 614 is split into a first divided flow 620 and second divided flow 622. In the final spiral mixing block 636, the divided flows, 620 and 622, are mixed in the final mixing chamber 630 into one final combined flow 634 where a cone feature 624 prevents recirculation flows from developing. The final combined flow 634 continues the spiral mixing action in the outlet block 649.

Figure 7:
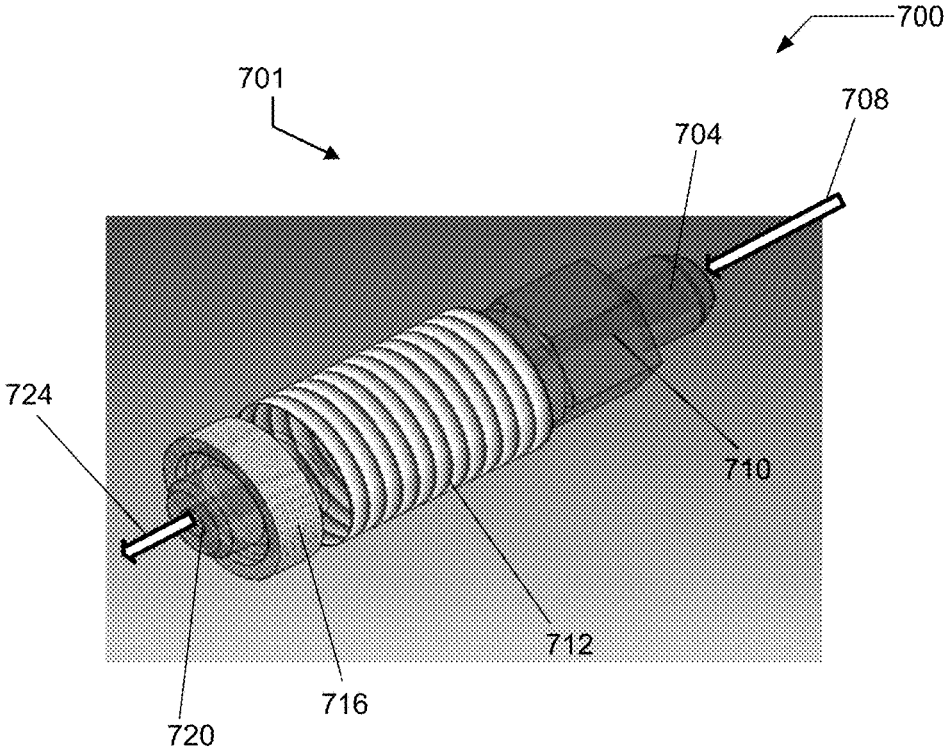
FIG. 7 depicts a schematic of a portion of the outlet block of a spiral mixer in an embodiment.

FIG. 7 depicts a schematic 700 of the downstream portion 701 of the final spiral mixing block and the front portion of the outlet block of a spiral mixer in an embodiment. The combined spiraling flow 708 from the flow divider block (not shown) enters the final mixer volume 704 and final mixing chamber 710 where the uniformity of mixing of the two fluids is refined. The downstream portion 701 includes non-slip material 712 used for holding the downstream portion 701 while being coupled using the screw portion 716. The outlet spiraling flow 724 passes through the outlet block 720.

Figure 8:
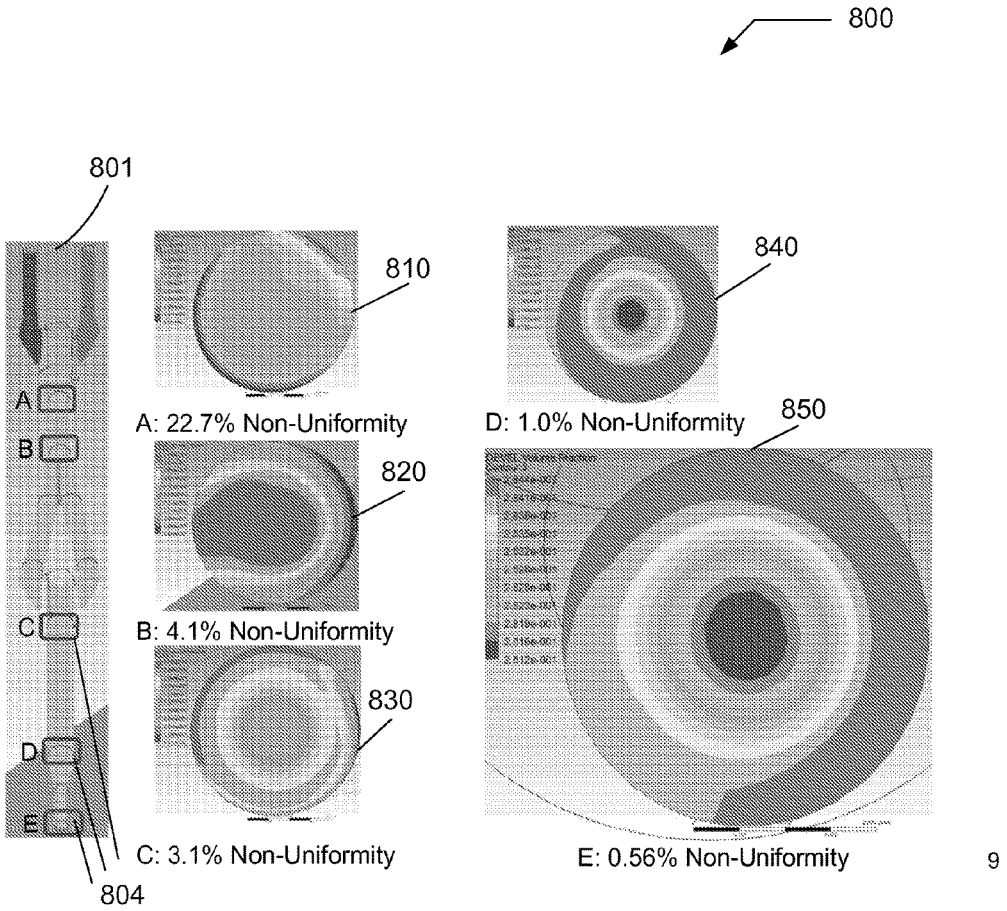
FIG. 8 shows a set of non-uniformity contour images of the combined spiral flow of the spiral mixer at critical junctions of the mixing process in an embodiment.

FIG. 8 shows a set of non-uniformity contour images 800 of the combined spiral flow in the spiral mixer 801 at critical junctions 804 of the mixing process in an embodiment. A critical junction 804 of the mixing process depicts a non-uniformity contour image at point A 810 after the first fluid and the second fluid are mixed in the first spiral mixing block where the non-uniformity is at 22.7%. The next critical junction depicts a non-uniformity contour image at point B 820 after the combined spiraling flow has travelled the first spiral mixing chamber but before being divided into two separate spiraling flows where the non-uniformity is 4.1%. Another critical junction depicts a non-uniformity contour image at point C 830, which is right after the divided flows are recombined in the beginning of the outlet block where the non-uniformity is 3.1%. The next critical junction depicts a non-uniformity contour image at point D 840 in the outlet mixing chamber prior to the reduction in the diameter of the outlet mixing chamber where the non-uniformity is 1.0%. Finally, the last critical junction depicts a non-uniformity contour image at point E 850 prior to the spiraling flow being delivered to the dispensing device outside of the outlet block where the non-uniformity is 0.56%, which would meet a mixing objective of 1% or less. Other critical junction schemes can be implemented for configurations of the spiral mixer with more than one mixing module in order to ensure achieving the percentage non-uniformity objectives.

Figure 9:
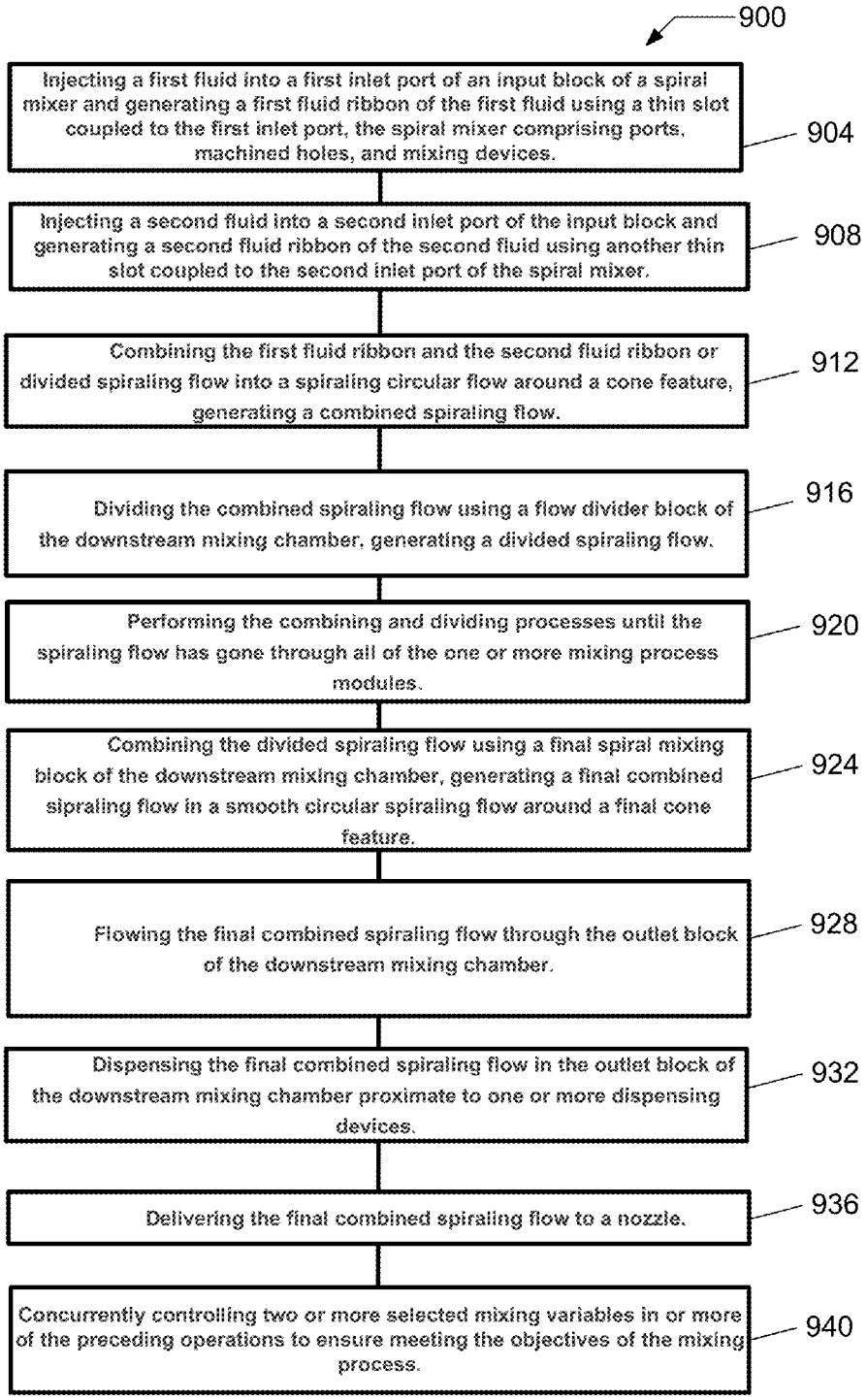
FIG. 9 shows a flow chart illustrating an exemplary method for mixing two fluids using a spiral mixer in an embodiment.

FIG. 9 shows a flow chart 900 illustrating an exemplary method for mixing two fluids using a spiral mixer in an embodiment. In operation 904, a first fluid is injected into a first inlet port of an input block of the spiral mixer generating a first fluid ribbon of the first fluid using a first narrow-gap slot coupled to the first inlet port, the spiral mixer comprising ports, mixing chambers of the input block, first spiral mixing block, first flow divider block, final spiral mixing block, and outlet block, and mixing devices. In operation 908, a second fluid is injected into a second inlet port of the input block, generating a second fluid ribbon of the second fluid using a second narrow-gap slot coupled to the second inlet port of the spiral mixer.

Referring to FIG. 9, in operation 912, the first fluid ribbon and the second fluid ribbon are combined into a spiraling circular flow around a cone feature in the mixing chamber of the first spiral mixing block or if there are more than one mixing module, the divided spiraling flow of a previous flow dividing block, generating a combined spiraling flow. In operation 916, the combined spiraling flow is divided in the mixing chamber of the first flow divider block, generating a divided spiraling flow. In operation 920, the combining and dividing processes are performed until the spiraling flow has gone through all of the one or more mixing process modules. In operation 924, the divided spiraling flows are combined using a final spiral mixing block of a mixing chamber of the final spiral mixing block, generating a final combined spiraling flow in a smooth circular spiraling flow around a final cone feature. In operation 928, the final combined spiraling flow is flowed into the mixing chamber of the outlet block. In operation 932, the final combined spiraling flow is flowed through the outlet block.

Still referring to FIG. 9, in operation 936, the final combined spiraling flow is dispensed onto a substrate. In one embodiment, the final combined spiraling flow is delivered to a nozzle attached to an arm in a semiconductor clean track process chamber. In another embodiment, the final combined spiraling flow can be delivered to another dispense device such as a sprayer or delivered directly into the process chamber. In operation 940, two or more selected mixing variables of the mixing process are concurrently controlled in order to meet the target mixing objectives. The two or more mixing variables comprises force of injection of the first fluid, force of injection of the second fluid, density and/or viscosity of the first fluid and second fluid, flow rate of the diffused fluid, back pressure of the downstream mixing chamber, residence time of the first fluid and second fluid in the downstream mixing chamber, and/or outlet pressure at the end of the outlet block.

As mentioned above, the target mixing objectives can include non-uniformity of the outlet spiraling flow; absence of turbulence in the spiraling flows of the first fluid ribbon and the second fluid ribbon through the mixing chamber of the input block, absence of turbulence of the spiraling flows in the mixing chamber in the mixing module, the final mixing block, and the outlet block; absence of dead legs or recirculation loops in the mixed spiraling flows of the first fluid and the second fluid through the mixing chambers of the spiral mixer, residence time, and total volume of first fluid and second fluid.

With reference to FIG. 9, if only one mixing module is used, then operation 920 is not needed. Diffusion is a slow process and is a function of concentration gradient between the first fluid and the second fluid and distance travelled while diffusion is taking place. The number of mixing modules is based on the application and the selected mixing objectives where the application is characterized primarily by the choice of the first fluid and the second fluid used for the mixing process. As mentioned above, the number of mixing modules is further influenced by the distance of spiral mixing or diffusion of the first and the second fluid in order to achieve the non-uniformity objective. This needs to be balanced with the need to preserve the chemical structure of the first and the second fluid. For example, turbulence of the mixture degrades chemicals like resists. Turbulence can be avoided by designing the mixing chamber of the spiraling mixer such that a smooth flow happens at connection points and there are no dead legs or recirculation loops. Calculations related to diffusion are based on Fick's first and second laws of diffusion and are known to people knowledgeable in the art; for more details, refer to "Fick's laws of diffusion", available in Wikipedia, at //en.wikipedia.org/wiki/Fick%27s_law_of_diffusion, which is included herein by reference in its entirety.

Figure 10:
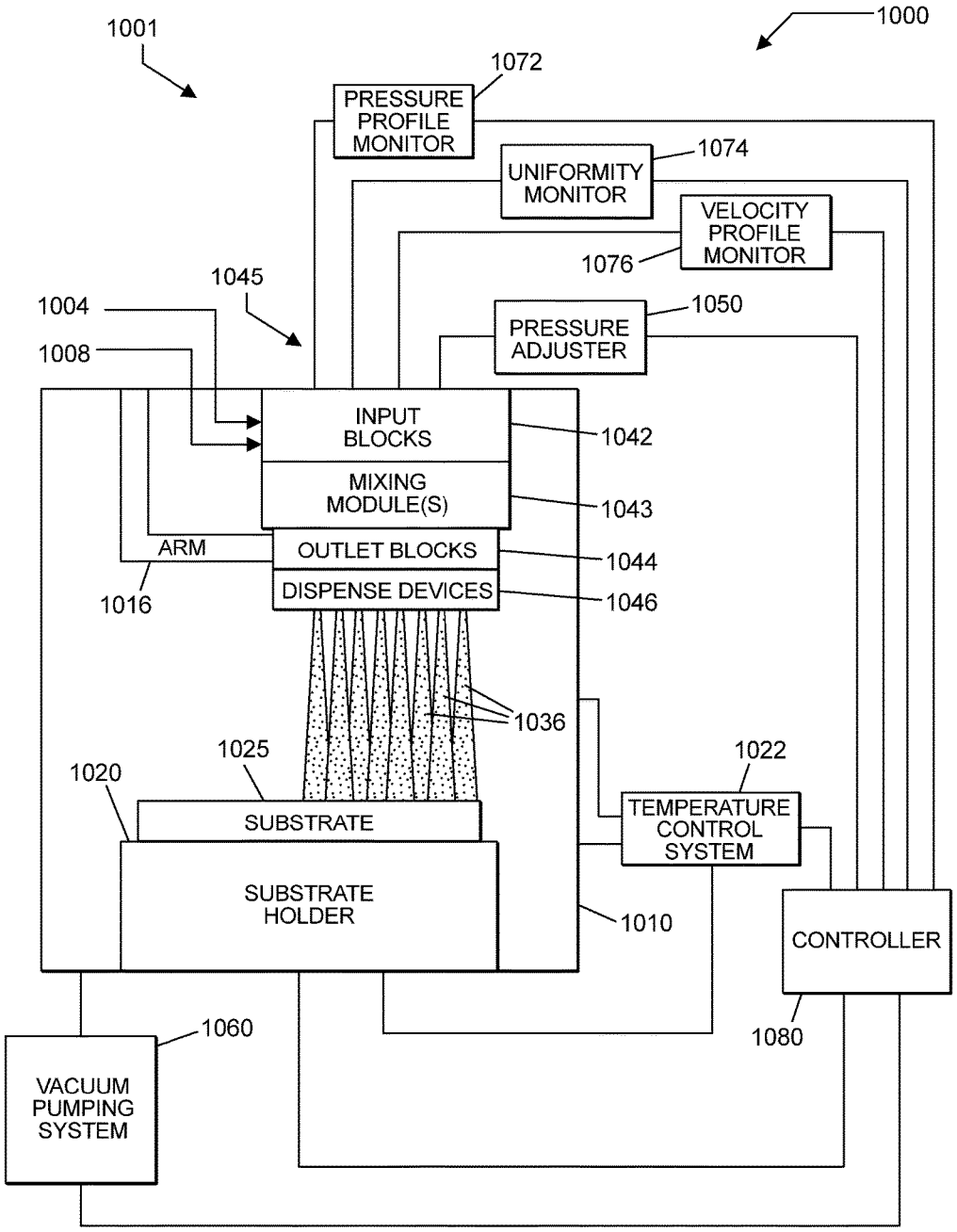
FIG. 10 shows a schematic representation of a single substrate system comprising a plurality of spiral mixers dispensing the diffused fluid onto a substrate according to an embodiment.

FIG. 10 shows a schematic representation 1000 of a fabrication system 1001 comprising a fluid mixing system 1045 delivering a diffused fluid to a dispense device 1046 according to an embodiment. The fabrication system 1001 comprises a process chamber 1010 having a substrate holder 1020 configured to support a substrate 1025. Furthermore, the substrate holder 1020 is configured to control the temperature of the substrate 1025 at a temperature suitable for the fluid mixing processes. The process chamber 1010 is coupled to a fluid mixing system 1045. A pressure adjuster 1050 is coupled to the fluid mixing system 1045 and is configured to adjust the pressure in the first injector 1004 or the second injector 1008 in order to achieve a target pressures. As mentioned above, there may be two or more injectors or one injector used sequentially for fluid injections. The process chamber 1010 is further coupled to a vacuum pumping system 1060 wherein the vacuum pumping system 1060 is configured to evacuate the process chamber 1010 to a pressure suitable pressure for processing the substrate 1025.

Referring again to FIG. 10, a temperature control system 1022 can be coupled to the fluid mixing system 1045, the process chamber 1010 and/or the substrate holder 1020, and configured to control the temperature of one or more of these components. The temperature control system 1022 can include a temperature measurement system configured to measure the temperature of the fluid mixing system 1045 at one or more locations, the temperature of the process chamber 1010 at one or more locations and/or the temperature of the substrate holder 1020 at one or more locations. The measurements of temperature can be used to adjust or control the temperature at one or more locations in fabrication system 1001. According to program instructions from the temperature control system 1022 or the controller 1080 or both, the pressure adjuster 1050 can be configured to operate the fluid mixing system 1045 at a temperature selected based upon the application.

Additionally yet, according to program instructions from the temperature control system 1022 or the controller 1080 or both, the temperature of the process chamber 1010 can be set to a value less than the temperature of the fluid mixing system 1045 i.e., the one or more heating elements. Further, according to program instructions from the temperature control system 1022 or the controller 1080 or both, the substrate holder 1020 can be configured to set the temperature of substrate 1025 to a value less than, equal to, or more than the temperature of the fluid mixing system 1045, and the process chamber 1010.

The substrate holder 1020 comprises one or more temperature control elements coupled to the temperature control system 1022. The temperature control system 1022 can include a substrate heating system, or a substrate cooling system, or both. Additionally, the substrate holder 1020 comprises a substrate clamping system (e.g., electrical or mechanical clamping system) to clamp the substrate 1025 to the upper surface of substrate holder 1020. For example, substrate holder 1020 may include an electrostatic chuck (ESC).

Furthermore, the substrate holder 1020 can facilitate the delivery of heat transfer gas to the back-side of substrate 1025 via a backside gas supply system to improve the gas-gap thermal conductance between substrate 1025 and substrate holder 1020. Such a system can be utilized when temperature control of the substrate is required at elevated or reduced temperatures.

Vacuum pumping system 1060 can include a turbomolecular vacuum pump (TMP). TMPs can be used for low pressure processing, typically less than approximately 1 Torr. For high pressure processing (i.e., greater than approximately 1 Torr), a mechanical booster pump and dry roughing pump can be used. Furthermore, a device for monitoring chamber pressure (not shown) can be coupled to the process chamber 1010.

Referring still to FIG. 10, the fabrication system 1001 can further comprise a controller 1080 that comprises a microprocessor, memory, and a digital I/O port capable of generating control voltages sufficient to communicate and activate inputs to fabrication system 1001 as well as monitor outputs from fabrication system 1001. Moreover, controller 1080 can be coupled to and can exchange information with the process chamber 1010, the substrate holder 1020, the temperature control system 1022, the fluid mixing system 1045, and the vacuum pumping system 1060, as well and/or the electrostatic clamping system (not shown). A program stored in the memory can be utilized to activate the inputs to the aforementioned components of fabrication system 1001 according to a process recipe in order to perform the method of fluid mixing application.

Controller 1080 may be locally located relative to the fabrication system 1001, or it may be remotely located relative to the fabrication system 1001 via an internet or intranet. Thus, controller 1080 can exchange data with the fabrication system 1001 using at least one of a direct connection, an intranet, or the internet. Controller 1080 may be coupled to an intranet at a customer site (i.e., a device maker, etc.), or coupled to an intranet at a vendor site (i.e., an equipment manufacturer). Furthermore, another computer (i.e., controller, server, etc.) can access controller 1080 to exchange data via at least one of a direct connection, an intranet, or the internet.

Referring to FIG. 10, the pressure profile monitor 1072 measures the pressure of the first fluid and the second fluid and the combined or divided spiraling flow at different points in the mixing chamber of the spiral mixer. The volume fraction or uniformity monitor 1074 measures the inverse of uniformity which is non-uniformity of the combined or divided spiraling flow at different points. In one embodiment, a non-uniformity of 1% or less is desirable. The velocity profile monitor 1076 measures velocity of the combined or divided spiraling flow at different points in the mixing chamber of the spiral mixer. Variations of the temperature, pressure, velocity, flow rate, non-uniformity, and/or Reynolds number are sent to the controller 1080 for corrective response.

The mixing module(s) 1043 are coupled to the input blocks 1042 and to the outlet blocks 1044. The outlet blocks 1044 are coupled to the dispense devices 1046. The input blocks 1042, the mixing modules 1043, the outlet blocks 1044, and the dispense devices 1046 can be an integrated unit attached to an arm 1016 inside the processing chamber 1010 of the fabrication system 1001. The dispense devices can be a nozzle or spray that dispenses final combined spiraling flow onto a substrate 1025. As mentioned above, the first fluid can be a resist and the second fluid can be a solvent, or the first fluid can be a resist and the second fluid can be a fluid to adjust resist viscosity, or the first fluid can be a resist and the second fluid can be a developer. The fluid mixing system can be used in a resist and solvent blended dispense process, a resist viscosity adjustment process, a developer concentration adjustment process, a rinse fluid blending process, or a PH (potential in hydrogen) shock defect reduction with deionized water (DI) process in a semiconductor fabrication system. Other fluids with a diffusivity of about 1E-9 can be mixed using a spiral mixer as described above.

Although only certain embodiments of this invention have been described in detail above, those skilled in the art will readily appreciate that many modifications are possible in the embodiments without materially departing from the novel teachings and advantages of this invention. For example, the applications of the principles and techniques of fluid mixing using a spiral mixer where a selected two or more mixing variables are concurrently controlled to meet target objectives have many other uses in addition to semiconductor manufacturing. Accordingly, all such modifications are intended to be included within the scope of this invention.

What is claimed is:

1. A system designed to combine and uniformly blend two or more fluids, the system comprising a spiral mixer, the spiral mixer comprising:

a first injector configured to inject a first fluid into a first inlet port of an input block of the spiral mixer, the first inlet port coupled to a first slot-shaped passage for generating a first fluid ribbon;

a second injector configured to inject a second fluid into a second inlet port of the input block, the second inlet port coupled to a second slot-shaped passage for generating a second fluid ribbon;

a mixing module coupled to the first injector and the second injector and configured to receive the first fluid ribbon and the second fluid ribbon from the first and second slot-shaped passages in opposing relation with the first fluid ribbon on top of the second fluid ribbon into a mixing chamber and perform a mixing process, the mixing module generating two mixed spiraling flows, the mixing module comprising:

a first spiral mixing block coupled to the input block via a first cylindrical mixing chamber having a cone feature therein and configured to perform a first stage mixing of the opposed first fluid ribbon and the second fluid ribbon around the cone feature in a smooth combined spiraling flow;

a flow divider block coupled to the first spiral mixing block via a flow divider mixing chamber and configured to divide the combined spiraling flow into two mixed spiraling flows;

a final spiral mixing block coupled to the flow divider block and configured to combine the two mixed spiraling flows into a combined mixed spiraling flow using a final mixing chamber and configured to refine a mixing uniformity of the combined mixed spiraling flow, generating a combined final spiraling flow; and an outlet block coupled to the final spiral mixing block and configured to continue mixing of the combined final spiraling flow in an outlet mixing chamber to achieve target mixing objectives for an outlet spiraling flow exiting the outlet block;

a control system for monitoring and adjusting the mixing process, wherein two or more selected mixing variables of the mixing process are concurrently controlled and kept within acceptable ranges in order to achieve the target mixing objectives for the outlet spiraling flow.

2. The system of claim 1 wherein target mixing objectives include non-uniformity of the outlet spiraling flow being 1% or less.

3. The system of claim 2 wherein the target mixing objectives include the absence of turbulence in the first fluid ribbon and the second fluid ribbon through the input block and absence of turbulence of the spiraling flows in the mixing chamber in the mixing module, the final spiral mixing block, and the outlet block.

4. The system of claim 1 wherein the total volume of the mixing chamber of the spiral mixer is in a range from 0.2 to 0.8 $cm^3$ and wherein the outlet spiraling flow of the outlet block is delivered proximate to a dispense device.

5. The system of claim 1 further comprising a third injector configured to inject a third fluid into a third inlet port of the input block of the spiral mixer, the third inlet port coupled to a third slot-shaped passage for generating a third fluid ribbon.

6. The system of claim 1 wherein the first fluid is a resist and the second fluid is a developer or wherein viscosity and density of the first fluid and the second fluid are close to the viscosity and density of water.

7. The system of claim 1 wherein the first injector injects the first fluid with a force in a range of 5.0 to 9.0 $e^{-4}$ kg/s, the second injector injects the second fluid with a force in a range of 1.0 to 5.0 $e^{-4}$ kg/s, and a width of each of the first slot-shaped passage and the second slot-shaped passage is in a range from 0.10 to 0.20 mm.

8. The system of claim 7 wherein an outlet pressure for the outlet spiraling flow in the outlet block is in a range from 1 to 7 psi or wherein a volume flow rate of the outlet spiraling flow is in a range from 0.5 to 3.0 cc/s or wherein residence time for the first fluid and the second fluid in the mixing module is in a range from 0.1 to 0.5 s or wherein a back pressure in the flow of the outlet spiraling flow is in a range from 0.1 to 0.9 psi.

9. The system of claim 1 wherein the mixing module comprises two or more connected mixing modules.

10. The system in claim 9 wherein the number of connected mixing modules is based on an application and the selected mixing objectives, the application characterized primarily on the first fluid and the second fluid used in the mixing process.

11. The system in claim 9 wherein the number of connected mixing modules is influenced by a requirement to have a required distance of laminar mixing of the first and the second fluid in order to achieve a non-uniformity objective and the need to preserve the chemical structure of the first and the second fluid.

12. The system in claim 1 wherein a cone feature at a beginning of the first spiral mixing block and at a beginning of the final spiral mixing block is designed to reduce stagnation and recirculation of the combined spiraling flow.

13. The system in claim 1 wherein the first fluid is deionized water and the second fluid is a developer solution.

14. The system in claim 1 wherein the two or more mixing variables include force of injection of the first fluid, force of injection of the second fluid, density and/or viscosity of the first fluid and the second fluid, flow rate of the combined spiraling flow, back pressure at the mixing module, residence time of the first fluid and second fluid in the mixing module, outlet pressure of the outlet spiraling flow, Reynolds number of the combined spiraling flow, percentage non-uniformity of the combined spiraling flow, and distance travelled by the combined spiraling flow.

15. The system of claim 1 wherein blocks of the spiral mixer are fabricated from perfluoro-alkoxy (PFA), poly-chloro-triflouro-ethylene (PCTFE), or poly-tetra-flouro-ethylene (PTFE).

16. The system of claim 1 wherein poly-tetra-flouro-ethylene (PTFE) gaskets are used in between blocks or in between portions of blocks of the spiral mixer to prevent leakage of the first fluid, the second fluid or the combined spiraling flow.

17. The system of claim 1 wherein the spiral mixer comprises blocks that include machined holes or mixing chambers and mixing features wherein the blocks utilize a sealant in between the blocks or in between portions of the blocks and wherein a compressive force is applied to create a seal in between the blocks or portion of the blocks.

18. The system of claim 1 wherein a plurality of spiral mixers are supplied by a common delivery device for the first fluid and a common delivery device for the second fluid and the outlet spiraling flow of each mixer is delivered to a dispense device.

* * * * *